US009567700B2

(12) United States Patent
Hong et al.

(10) Patent No.: US 9,567,700 B2
(45) Date of Patent: Feb. 14, 2017

(54) LAUNDRY TREATING APPARATUS WITH SOLVENT SUPPLY PART FOR DRY-CLEANING SOLVENT

(75) Inventors: Sang Wook Hong, Seoul (KR); Jae Won Chang, Seoul (KR); Sun Young Park, Seoul (KR); Bon Kwon Koo, Seoul (KR); Ki Young Kang, Seoul (KR); Ji Hee Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1052 days.

(21) Appl. No.: 13/260,123

(22) PCT Filed: Sep. 11, 2009

(86) PCT No.: PCT/KR2009/005186
§ 371 (c)(1),
(2), (4) Date: Sep. 23, 2011

(87) PCT Pub. No.: WO2010/128731
PCT Pub. Date: Nov. 11, 2010

(65) Prior Publication Data

US 2012/0017381 A1 Jan. 26, 2012

(30) Foreign Application Priority Data

May 4, 2009 (KR) ..... 10-2009-0039053

(51) Int. Cl.
*D06F 43/00* (2006.01)
*D06F 43/08* (2006.01)
(Continued)

(52) U.S. Cl.
CPC ..... *D06F 25/00* (2013.01); *D06F 35/00* (2013.01); *D06F 39/022* (2013.01);
(Continued)

(58) Field of Classification Search
CPC ..... D06F 43/00; D06F 43/007; D06F 43/08; D06F 43/085; D06F 43/02; D06F 43/088; D06F 43/081; D06F 43/083; D06F 43/086; D06F 25/00; D06F 35/00; D06F 39/022; D06F 39/125
(Continued)

(56) References Cited

U.S. PATENT DOCUMENTS 6,059,845 A 5/2000 Berndt et al.
2004/0231371 A1* 11/2004 Scheper et al. ..... 68/3 R
(Continued)

FOREIGN PATENT DOCUMENTS

KR 2007002287 A 1/2007

OTHER PUBLICATIONS

International Search Report mailed Sep. 7, 2010 from International Application No. PCT/KR2009/005186, 3 pages.

*Primary Examiner* — Joseph L Perrin
*Assistant Examiner* — Irina Graf
(74) *Attorney, Agent, or Firm* — Fish & Richardson P.C.

(57) ABSTRACT

A laundry treating apparatus includes a casing, a tub provided in the casing (10), and a rotatable drum (20) provided in the tub. The laundry treating apparatus also includes a water supply part provided in the casing to supply water to the rotatable drum and a solvent supply part supplying dry-cleaning solvent to the rotatable drum. The laundry treating apparatus further includes a condensation device that condenses a gaseous portion of the solvent into a liquid form and supplies the solvent in the liquid form to the solvent supply part.

16 Claims, 11 Drawing Sheets

(51) Int. Cl.

| | |
|---|---|
| ***D06F 25/00*** | (2006.01) |
| ***D06F 35/00*** | (2006.01) |
| ***D06F 39/02*** | (2006.01) |
| ***D06F 39/12*** | (2006.01) |
| ***D06F 43/02*** | (2006.01) |

(52) U.S. Cl.
CPC ..... *D06F 39/125* (2013.01); *D06F 43/02* (2013.01); *D06F 43/085* (2013.01); *D06F 43/088* (2013.01)

(58) Field of Classification Search
USPC ..... 8/137, 142, 158; 68/12.08, 18 R
See application file for complete search history.

(56) References Cited

U.S. PATENT DOCUMENTS

| | | | | |
|---|---|---|---|---|
| 2004/0267473 | A1 | 12/2004 | Scheper et al. | |
| 2005/0043196 | A1* | 2/2005 | Wright et al. | 510/276 |
| 2005/0050644 | A1 | 3/2005 | Severns et al. | |
| 2005/0071929 | A1* | 4/2005 | Mani et al. | 8/158 |
| 2005/0166644 | A1 | 8/2005 | Gerald France et al. | |
| 2009/0095750 | A1* | 4/2009 | Vitan et al. | 220/23.83 |

* cited by examiner

LAUNDRY TREATING APPARATUS WITH SOLVENT SUPPLY PART FOR DRY-CLEANING SOLVENT

CROSS-REFERENCE TO RELATED APPLICATIONS

This application claims priority to International Application No. PCT/KR2009/005186 filed on Sep. 11, 2009, which application claims priority to Korean Application No. 10-2009-0039053, filed May 4, 2009. The entire contents of the above applications are incorporated herein by reference in their entireties.

TECHNICAL FIELD

The present invention relates to a laundry treating apparatus. More specifically, the present invention relates to a laundry treating apparatus that is able to wash or dry-clean laundry according to a user's selection.

BACKGROUND ART

Generally, a laundry treating apparatus may be referenced to as a washer, that is, washing machine or dryer. In recent, laundry treating apparatus having washing and drying functions have been produced.

Such a washing machine may be categorized based on an inner structure into a pulsator type washing machine and drum type washing machine. Such a dryer may be categorized into a drum type dryer and casing type dryer.

A conventional drum type washing machine includes a casing, a tub, an oriented-rotatable drum provided in the tub and a wash water supply pipe supplying wash water to the rotatable drum.

The wash water supply pipe is connected to a detergent box capable of receiving power and liquid detergent for washing.

According to such the configuration, once a user starts the above drum type washing machine after introducing laundry into the drum, detergent mixed with wash water may be supplied to the rotatable drum and washing may be performed, with the rotation of the drum dropping the laundry. After the washing cycle, rinsing and spinning cycles are performed.

The laundry having the spinning cycle completed may be dried in an auxiliary dryer installed to the washing machine or it may be moved to a separate dryer to be dried.

DISCLOSURE OF INVENTION

Technical Problem

According to the conventional laundry treating machine, only the washing and drying are performed and there may be a disadvantage that fat-soluble contaminants or stains cannot be treated.

That is, such the conventional laundry treating apparatus has no dry-cleaning function and it can bring user inconvenience disadvantageously. As usage of laundry requiring only dry-cleaning has been increasing, demands for the dry-cleaning function of the conventional laundry treating machine have been increasing accordingly.

Solution to Problem

To solve the problems, an object of the present invention is to provide a laundry treating apparatus capable of both washing and dry-cleaning and a control method of the same.

To achieve these objects and other advantages and in accordance with the purpose of the invention, as embodied and broadly described herein, a laundry treating apparatus includes a casing; a tub provided in the casing; a rotatable drum provided in the tub; a water supply part provided in the casing to supply water to the rotatable drum; and a solvent supply part supplying dry-cleaning solvent to the rotatable drum.

The solvent supply part may include a solvent receiving part receiving the solvent therein; a pump connected to the solvent receiving part to supply the solvent to the rotatable drum; and a spraying device connected to the pump to spray the solvent onto the rotatable drum.

The laundry treating apparatus may further include a solvent collecting part collecting the solvent sprayed into the rotatable drum. Here, the solvent collecting part may include a solvent collecting pipe guiding the collected solvent toward the solvent receiving part; and a filter part connected to the solvent collecting pipe to filter foreign substances contained the collected solvent.

The solvent collecting part may further include a condensation device condensing gaseous solvent to supply liquid solvent to the solvent receiving part, if the collected solvent is gaseous.

The laundry treating apparatus may further include a closable valve provided between the condensation device and the solvent receiving part to control the flow of the liquid solvent.

The filter part may include a replaceable filter cartridge that is able to be inserted in the casing.

The laundry treating apparatus may further include a surfactant receiving part provided adjacent to the solvent receiving part to receive surfactant therein and the solvent receiving part and the surfactant receiving part may include covers to selectively open and close insides, respectively, and the covers may be exposed to a supply groove formed in a predetermined portion of the casing.

The laundry treating apparatus may further include a cover member rotatably coupled to an outer portion of the casing to prevent the filter cartridge or the covers from exposing outside.

The laundry treating apparatus may further include a hot air supply device provided in the casing to supply hot air to the rotatable drum, the hot air supply device connected to the tub.

The laundry treating apparatus may include a washing machine and a drying machine, and the spraying device may be provided in a tub or a casing of the washing machine to spray solvent toward an opening of a rotatable drum of the washing machine.

The laundry treating apparatus may include a washing machine and a drying machine, and the spraying device may be provided in a tub or a casing of the drying machine to spray solvent toward an opening of a rotatable drum of the drying machine.

The solvent supply part and the solvent collecting part may be provided in the casings of the washing machine and the drying machine, respectively.

The solvent supply part and the solvent collecting part may be provided in the casing of the washing machine or in the casing of the drying machine.

Supporting compartments may be provided under the casings of the washing machine and the drying machine, respectively, to heighten the installation height of the rotatable drums, the supporting compartments partitioned off from the casings. The solvent receiving part and the solvent collecting part may be provided in the supporting compartments.

The solvent receiving part and the solvent collecting part may be dividedly provided in the supporting compartment of the drying machine and the supporting compartment of the washing machine.

The solvent receiving part and the solvent collecting part may be provided in the supporting compartment of the drying machine or the supporting compartment of the washing machine.

The solvent supply pipe may include a solvent receiving part receiving solvent therein and a surfactant receiving part receiving surfactant therein, and the solvent collecting part may include a filter part filtering the collected solvent. A front of the supporting compartment may include a supply groove exposing predetermined portions of the solvent receiving part and the surfactant receiving part to enable the solvent or surfactant to be supplied thereto; and an attachment groove attachable to the front of the supporting compartment to enable a filter cartridge of the filter part to be replaceable.

A cover member covering the solvent receiving part and the filter part may be coupled to the front of the supporting compartment.

The solvent may be silicone oil.

In another aspect of the present invention, a control method of a laundry treating apparatus that is able to perform washing and dry-cleaning includes determining whether dry-cleaning is complete; washing off solvent used in the dry-cleaning by supplying a predetermined amount of water to the laundry treating machine, if it is determined that the dry-cleaning is complete.

The control method of the laundry treating apparatus may further include, if it is determined that the dry-cleaning is complete, displaying whether a user selects a laundry treating apparatus cleaning command; and cleaning an inside of the laundry treating apparatus if the user selects the laundry treating apparatus cleaning command.

Advantageous Effects of Invention

The present invention has following advantageous effects.

The laundry treating apparatus is able to perform dry-cleaning as well as washing. As a result, user convenience may be improved.

Furthermore, according to the laundry treating apparatus configured of a set of a washing machine and a drying machine, dry-cleaning is performed in the drying machine or the washing machine. In either of the two machines, washing is possible and in the other one, dry-cleaning is possible conveniently.

A still further, solvent/detergent in the laundry treating apparatus according to the present invention is reusable, not disposable, and this is advantageously effective in an economical aspect. Also, the solvent is not conventional toxic chemical but silicone oil useable in cosmetics. As a result, the laundry treating apparatus according to the present invention may perform eco-friendly dry-cleaning.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Figure 1:
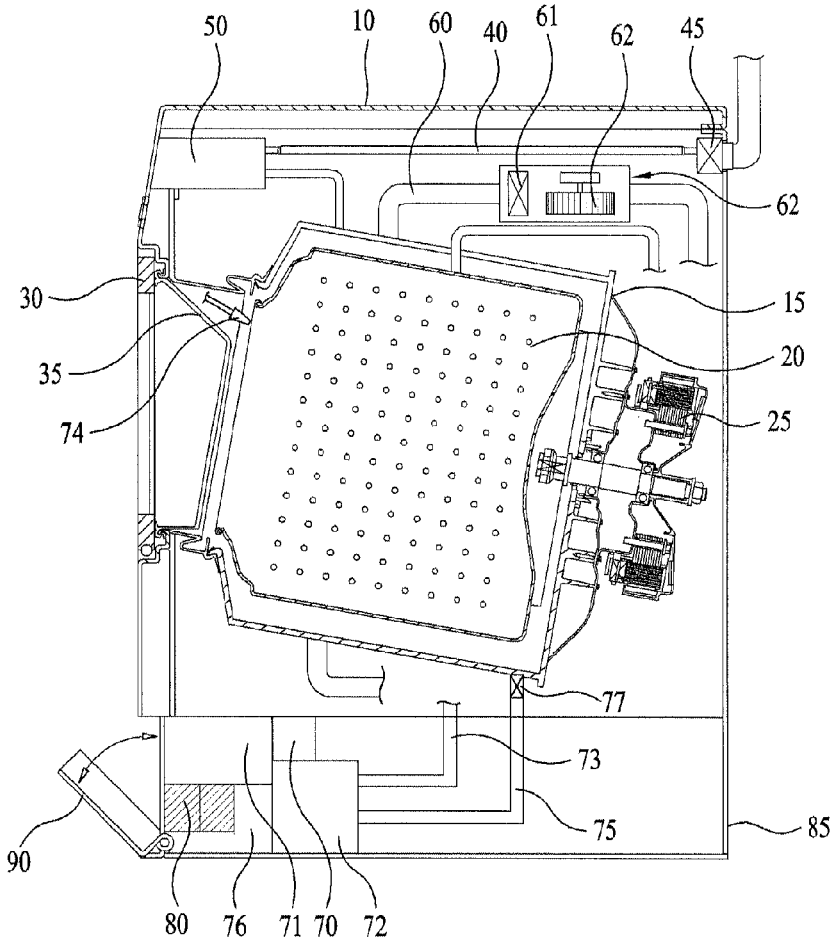
FIG. 1 is a side sectional view illustrating a laundry treating machine according to an exemplary embodiment of the present invention.

As shown in FIG. 1, a laundry treating machine according to an exemplary embodiment of the present invention includes a casing 10, a tub 15 and a rotatable drum 20. The casing 10 defines an exterior appearance of the laundry treating machine. The tub 15 is provided in the casing 10 and the drum 20 is rotatable in the tub 15.

A driving device 25 for driving the rotatable drum 20 is mounted to a rear of the drum 20 and it is preferable that this driving device 25 is configured of direct drive (DD) motor. Alternatively, the driving device 25 may be configured of a rotary motor and a driving pulley.

A door 30 is rotatably coupled to a front of the casing 10 to open and close an opening of the drum 20 and a transparent window 35 is provided in a center of the door 30 to make an inside of the rotatable drum 20 to be seen through.

A water supply pipe 40 and a water valve 45 may be provided in an upper portion of the casing 10. The water supply pipe 40 supplies wash water to the rotatable drum 20 and the water valve 45 is installed in the water supply pipe 40 to control the supply of wash water.

A detergent box 50 may be detachably provided in a predetermined upper portion of the front of the casing 10 and the detergent box 50 is connected to the water supply pipe 40, receiving power or liquid detergent therein. Here, the detergent box 50 may be detachable in a forward direction.

A hot air supply device 55 may be connected to the tub 15 to supply hot air to the rotatable drum 20. The hot air supply device 55 includes a guide duct 60 connected to the tub 15, a heating device 61 provided in the guide duct 60 and a fan 62 installed adjacent to the heating device 61 to blow the hot air.

Here, the guide duct 60 may have a circulation duct type.

A predetermined configuration for dry-cleaning the laundry may be provided outside the tub 15. Specifically, the configuration for dry-cleaning the laundry may include a solvent supply part for supplying dry-cleaning solvent to the rotatable drum 20 and a solvent collecting part for re-collecting the solvent supplied to the rotatable drum 20.

Here, the solvent supply part includes a solvent receiving part 70 accommodating fluidal solvent, a surfactant receiving part 71 connected to the solvent receiving part 70 to accommodating surfactant capable of helping the solvent to remove dirt or stains smoothly during the dry-cleaning, a pump 72 connected to both of the solvent receiving part 70 and the surfactant receiving part 71 to pump mixture of the solvent and surfactant, a solvent supply pipe 73 allowing the pumped mixture to flow along, and a solvent spray device provided at an end of the solvent supply pipe 73 to spray the solvent into the rotatable drum.

Here, the solvent receiving part 70 may be provided in the casing 10 together with the pump 72 or it may be provided outside the casing 10, with the pump 72 inside the casing 10.

The solvent spray device 74 may be installed adjacent to the opening of the rotatable drum 20 to spray the solvent into the drum inside uniformly. For that, the solvent spray device 74 may be installed in the tub 15 or in the opening of the casing 10.

At this time, the solvent receiving part should not be installed in a rotation trace of the door 30 to prevent contact with the transparent window 35 of the door 30.

The solvent collecting part includes a solvent collecting pipe 75 connected to the lower end of the tub 15 and a filter part 76 connected to an end of the solvent collecting pipe.

Here, a valve 77 is provided between the tub 15 and the solvent collecting pipe 75 to close the connection selectively.

The valve 77 is open in case the fluidal solvent is collected and it is closed vice versa.

The filter part 76 may be in communication with both the solvent receiving part and the pump 72 and a replaceable filter cartridge 80 is installed in the filter part 76.

The pump may be configured of a twin pump that is able to discharge the solvent and to draw the used solvent.

As a result, when the pump 72 drawing the solvent, the solvent provided in a lower portion of the tub 15 passes the pump 72, with being mixed with foreign substances of the laundry, and it passes the filter part 76 sequentially such that the solvent returns to the solvent receiving part 70 to be reusable.

As mentioned above, the cartridge 80 is replaceable and it may be installed in a front portion inside the casing 10 for this replacement.

The solvent receiving part 70 also may be installed in the front portion inside the casing 10 for the user to add insufficient solvent smoothly.

A cover member 90 may be rotatably coupled to a predetermined portion of the outer front of the casing 10 having the solvent receiving part 70 and the filter part 76 installed therein to selectively expose a predetermined portion of the casing 10 outside when adding both solvent and surfactant or replacing the filter cartridge 80.

As a result, the user may open the cover member 90 to replace the filter cartridge 80 or supply both of the solvent and surfactant. After that, the user may close the cover member 90 to prevent damage to the filter cartridge 80, solvent receiving part 70 and surfactant receiving part 71 because of external shock or collision.

Here, the solvent may be silicon oil for safety of human body and the protection of environments. That is, according to a conventional dry-cleaning, perchloroethylene (PERC) has been used as solvent and it would be harmful to human body because of its poisonous matters or smell.

Because of that, the dry-cleaning according to the embodiment of the present invention uses silicone oil that has been used in cosmetics.

Figure 2:
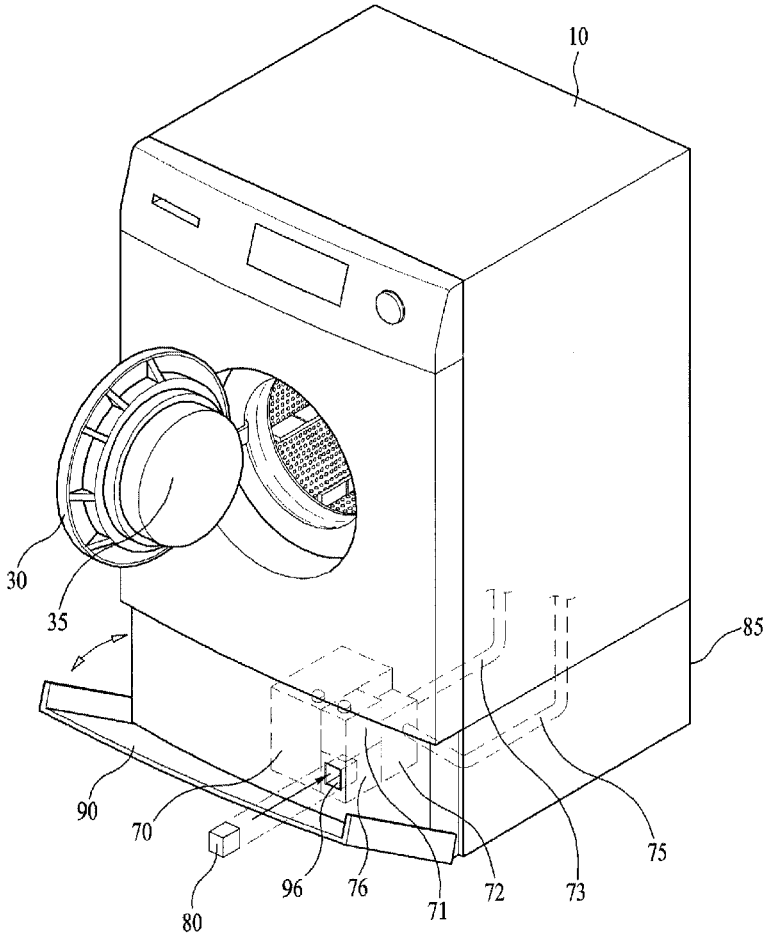
FIG. 2 is a perspective view illustrating a dry-cleaning module provided in a casing of the laundry treating machine according to the embodiment of the present invention.

As shown in FIG. 2, the solvent receiving part 70, the surfactant receiving part 71, the filter part 76 and the pump 72 may be accommodated in a supporting compartment 85 provided under the casing 10 or a predetermined portion except the space receiving the drum.

Alternatively, the solvent receiving part 70 and the surfactant receiving part 71 may be accommodated in the supporting compartment 85 and the pump 72 may be accommodated in the casing 10.

Here, the solvent receiving part 70, surfactant receiving part 71, filter part 72 and pump 72 may compose an integral unit as a single module. This case may enable efficient installation and repair and efficient space usage but the present invention is not limited to that case.

As mentioned in reference to FIG. 1, for the additional supply of the solvent and surfactant and the replacement of the filter cartridge, each front surface of the solvent receiving part 70, surfactant receiving part 71 and filter part 76 may be installed toward a front surface of the supporting compartment 85.

Here, the pump 72 may be installed in rear of the above three elements.

Figure 3:
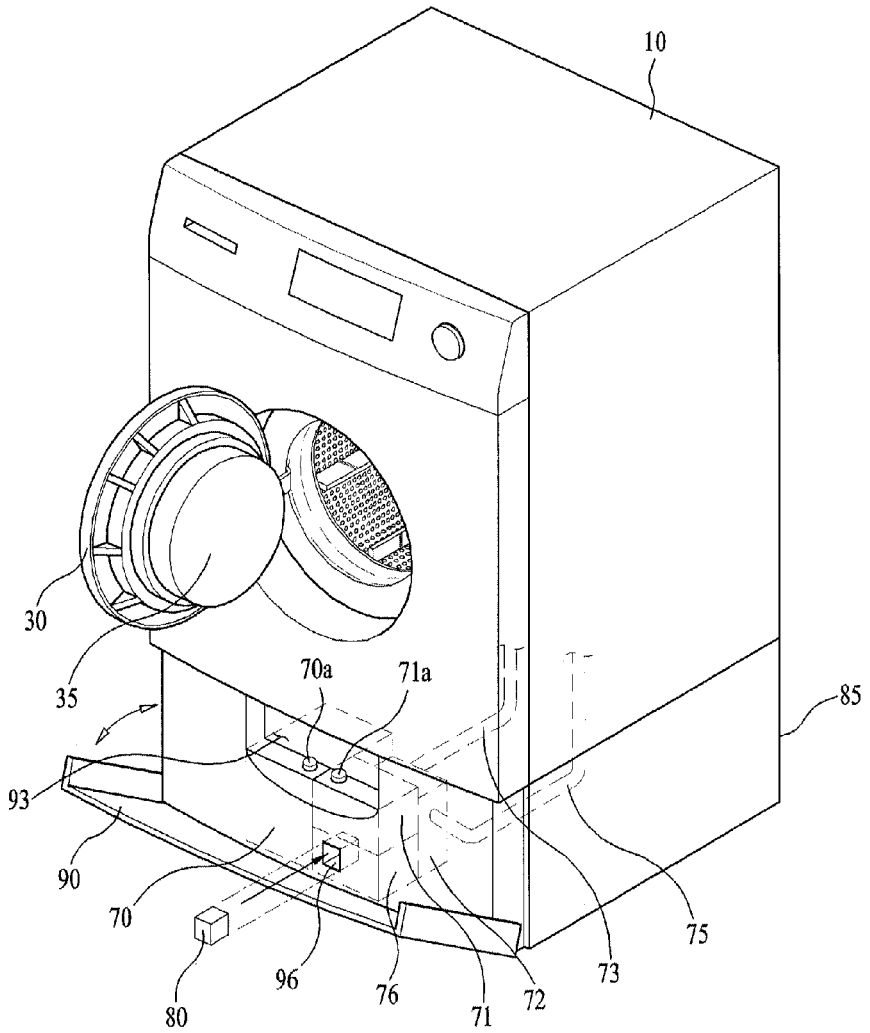
FIG. 3 is a perspective view illustrating the dry-cleaning module of FIG. 2 partially exposed outside.

As shown in FIG. 3, a supply groove 93 for the additional supply of the solvent and surfactant may be formed in the front surface of the supporting compartment 85 provided under the casing 10.

That is, predetermined portions of the surfactant receiving part 71 and the solvent receiving part 70 are exposed toward the front surface of the casing 10 such that the user may open and close a predetermined cover of each receiving part.

An attachment groove 96 is formed below the supply groove 93 and the filter cartridge 80 of the filter part 76 is slidingly attachable to the attachment groove 96.

The cover member 90 is coupled to the front of the supporting compartment 85 and it covers both of the supply groove 93 and the attachment groove 96. As mentioned above, the cover member 90 is provided to prevent the other elements from exposing outside except for the replacement of the filter cartridge 80 or for the supply of the solvent or surfactant.

Here, the cover member 90 may be formed in "⊏" shape to cover the front and predetermined portions of both sides of the supporting compartment 85.

That is, the front of the supporting compartment is stepped inward a predetermined distance with respect to the casing 10 and thus the cover member 90 may be formed to compensate the stepped portion.

Figure 4:
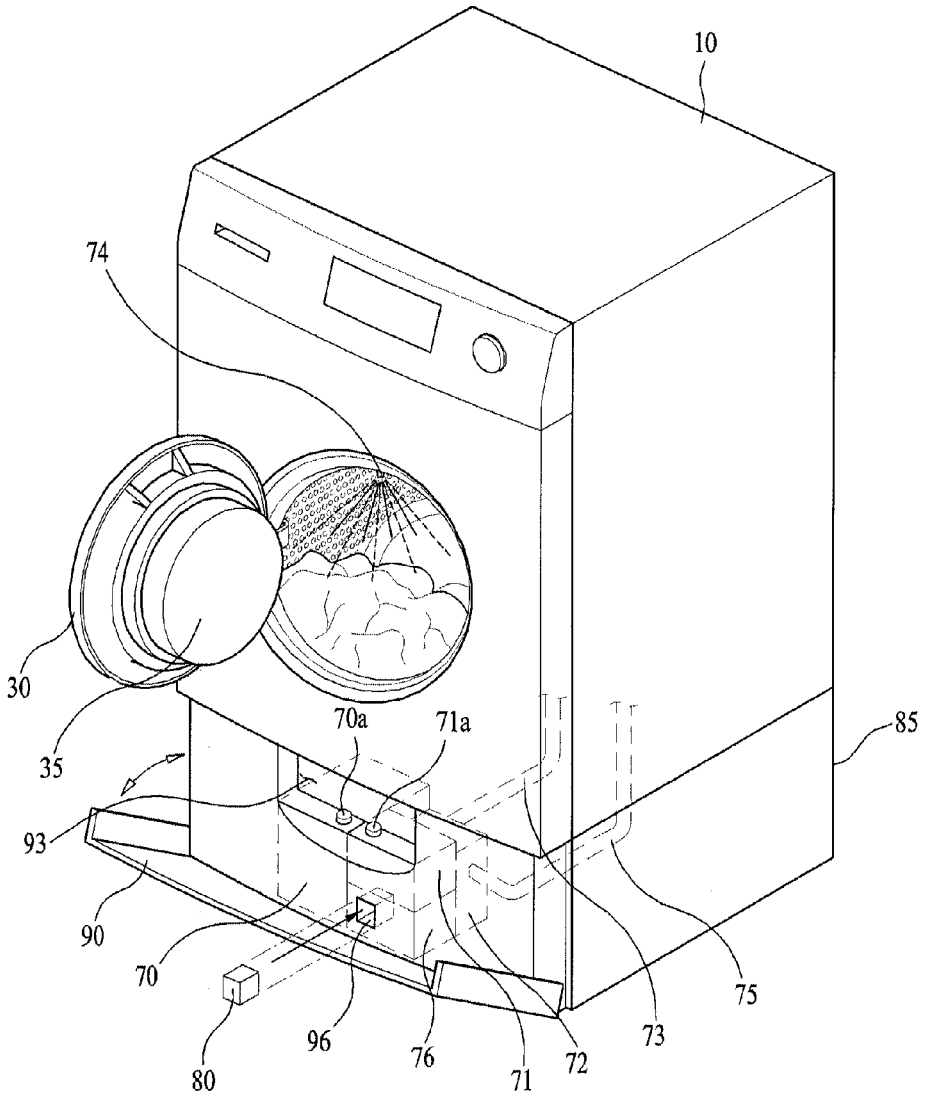
FIG. 4 is a perspective view illustrating a spray device mounted to the laundry treating machine.

FIG. 4 is illustrates an installation position of the spraying device 74 according to the present invention and it is preferable that a spraying hole of the spraying device 74 is installed toward the opening of the rotatable drum 20.

For that, the spraying device 74 may be installed in an upper front portion of the opening of the rotatable drum (20, see FIG. 1). Specifically, the spraying device 74 may be installed in an inner surface of the casing or an inner surface of the tub (15, see FIG. 1) to be secured stably.

Figure 5:
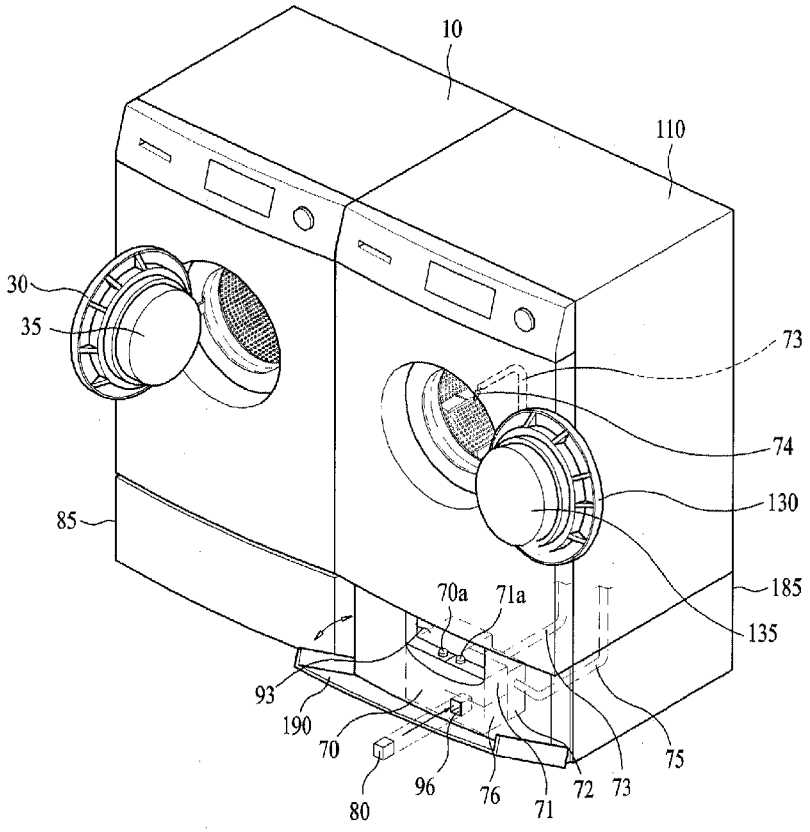
FIGS. 5 to 8 are perspective views illustrating a laundry treating machine configured of a set of a washing machine and a dryer, respectively.

FIG. 5 is a diagram illustrating a laundry treating apparatus configured of a washing machine and a drying machine separately installed therein according to another embodiment of the present invention.

That is, the laundry treating apparatus shown in FIGS. 1 to 4 includes the single casing with the washing and drying functions. In contrast, the laundry treating apparatus shown in FIG. 5 includes two casings with the functions, respectively.

In this case, supporting compartments 85 and 185 may be formed under the casing 10 of the washing machine and a casing 100 of the drying machine, respectively.

As shown in FIG. 5, a dry-cleaning module configured of the solvent supply part and the solvent collecting part may be installed in the supporting compartment 185 provided under the casing 100 of the drying machine and the spraying device 74 for spraying the mixture of the solvent and the surfactant is installed toward an opening of a rotatable drum 120 of the drying machine.

The supply groove 93 for additionally supplying the solvent and surfactant and the attachment groove 96 for replacement of the filter cartridge 80 of the filter part 76 may be provided in a front of the supporting compartment 185 provided under the casing 100 of the drying machine. Also, a cover member 190 may be coupled to the front of the supporting compartment 185 to cover the supply groove 93 and the attachment groove 96.

As dry-cleaning is performed for the laundry having washed, it is preferable that the dry-cleaning module is installed in the drying machine.

A relatively small-sized drum (not shown) may be further provided in the supporting compartment 85 of the washing machine to wash a relatively small amount of laundry or shoes.

Figure 6:
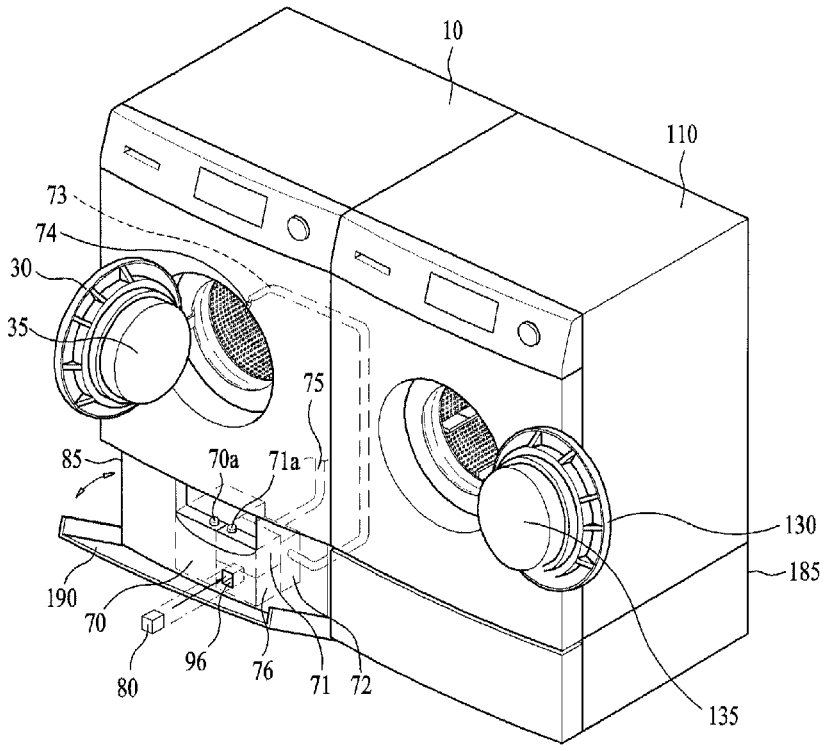

FIG. 6 is a diagram illustrating the dry-cleaning module installed in the supporting compartment provided under the washing machine. Here, it is preferable that the washing machine includes a device capable of performing a predetermined drying function.

The configuration of the dry-cleaning module including the solvent supply part and the solvent collecting part is identical to the configuration shown in FIGS. 1 and 2 and the detailed description thereof will be omitted accordingly.

Here, different from the laundry treating apparatus shown in FIGS. 1 and 2 including the single casing, the laundry treating apparatus shown in FIG. 6 is configured of a set of the washing machine and drying machine and it includes the washing machine capable of drying laundry such that drying may be performed in case of a large amount of laundry.

Also, according to the laundry treating apparatus shown in FIG. 6, not only washing but also dry-cleaning may be performed in the washing machine while dry-cleaning of the laundry having washed is performed in the drying machine.

Figure 7:
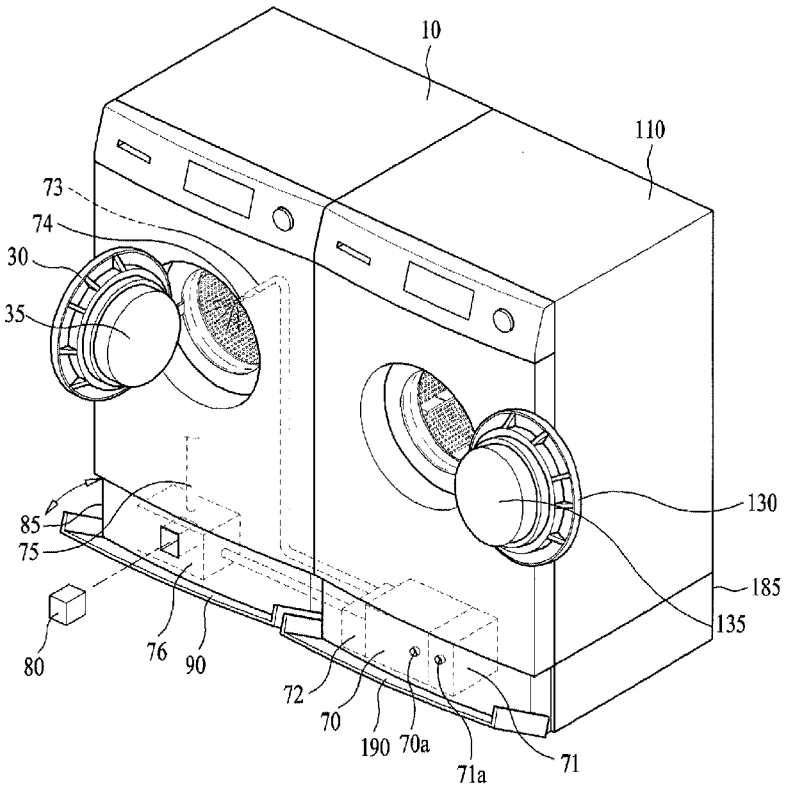
Figure 8:
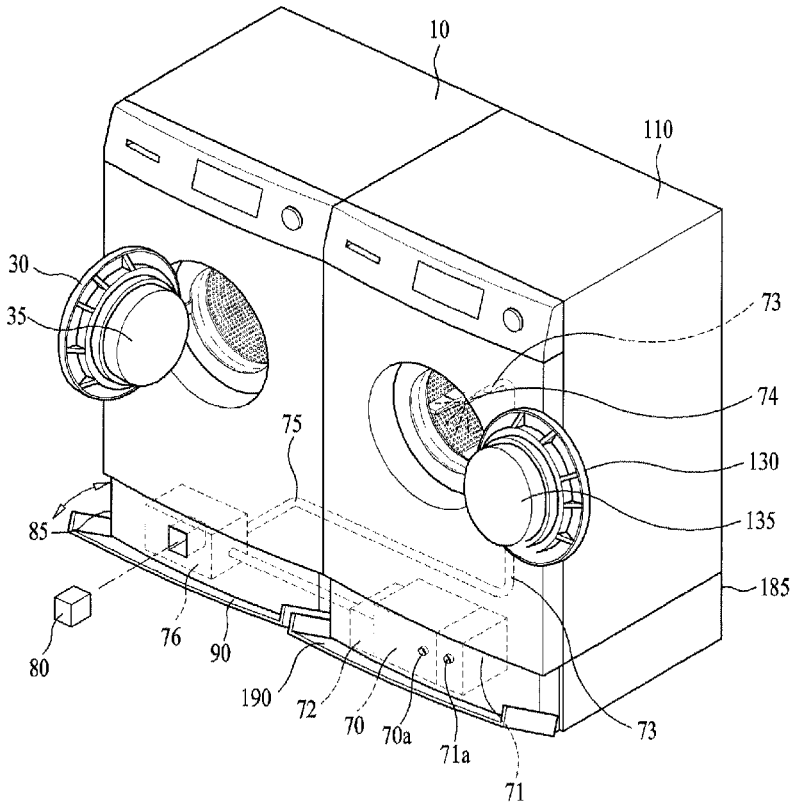

FIGS. 7 and 8 are diagrams illustrating a spraying device installed in a drying machine to spray the mixture of the solvent and surfactant and a spraying device installed in a washing machine, respectively.

A different feature of the laundry treating apparatus shown in FIGS. 7 and 8 in comparison to the laundry treating apparatus shown in FIGS. 5 and 6 is that the dry-cleaning module is installed in both of the drying machine and the washing machine dividedly.

The reason why the dry-cleaning module is provided dividedly will be described as follows. to improve dry-cleaning efficiency and to reduce the number of times the surfactant is additionally supplied and the number of times the filter cartridge is replaced, the sizes of the filter part 76, the solvent receiving part 70 and the surfactant receiving part 71 have to be increased. As a result, it is difficult to install all of these elements in the drying machine or the washing machine alone.

Because of that, in case the spraying device 74 is installed in the casing 10 of the washing machine, it is preferable that the filter part 76 is installed in the casing 10 or the supporting compartment 85 of the washing machine and that the other elements are installed in the casing 110 or the supporting compartment 185 of the drying machine.

Here, the attachment groove 96 for the attachment of the filter cartridge 80 may be provided in the portion where the filter part 76 is installed.

Covers 70*a* and 71*a* are exposedly installed in the portion where the solvent receiving part 70 and the surfactant receiving part 71 are installed to close the receiving parts.

Cover members 90 and 190 are rotatably coupled to fronts of the supporting compartments 85 and 185 of the washing and drying machines, respectively.

Figure 9:
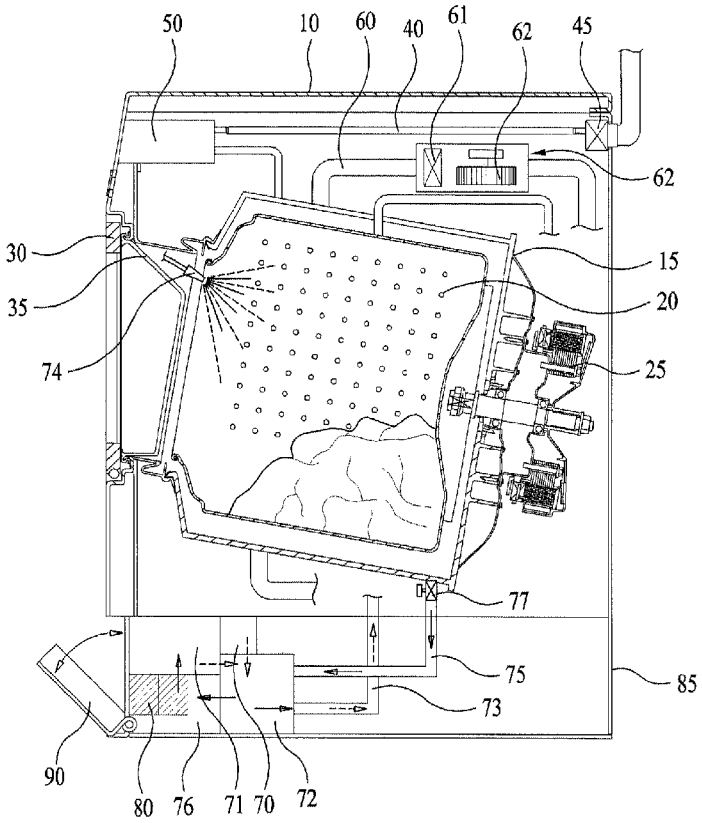
FIG. 9 is a diagram illustrating an operation of dry-cleaning in the laundry treating machine.

In reference to FIG. 9, operation of the laundry treating apparatus according to the exemplary embodiment of the present invention will be described.

First of all, the laundry is loaded in the rotatable drum 20 to dry-clean and a start button for starting dry-cleaning is pushed. Then, the solvent received in the solvent receiving part 70 and the surfactant received in the surfactant receiving part 71 are mixedly moved to the pump 72 by the pumping of the pump 72.

After having passed the pump 72 flows along the solvent supply pipe 73 and the spraying device 74 sequentially, the mixture is sprayed toward the laundry inside the rotatable drum 20.

With the rotation of the rotatable drum 20, the laundry is rotated, lifted and dropped to generate friction there between and contaminants or stains of the laundry is removed by chemical action of both the solvent and the surfactant.

Through the washing process, the mixture sprayed to the laundry is discharged from the rotatable drum and it is collected in the lower portion of the tub 15. The collected mixture is moved along the solvent collecting pipe 75 toward the pump to pass the filter part 76.

The filter part 76 separates foreign substances from solvent and the solvent separated by the filter part 76 is supplied to the solvent receiving part 70 to be reusable for dry-cleaning.

Figure 10:
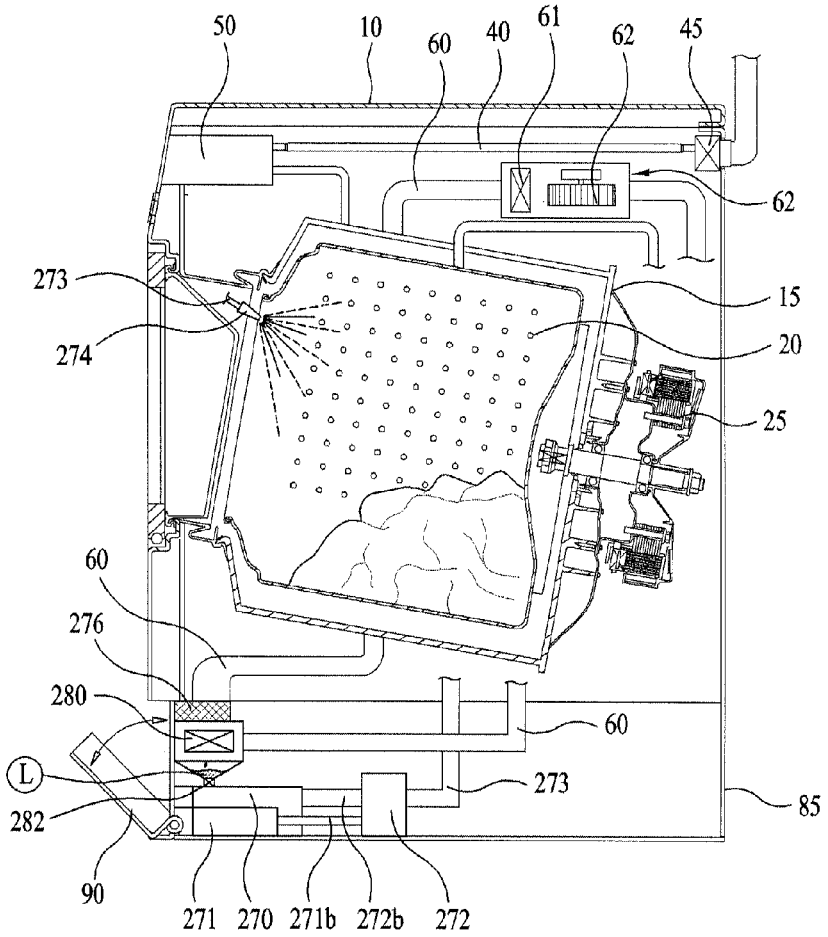
FIG. 10 is a side sectional view illustrating a laundry treating machine according to another embodiment of the present invention.

FIG. 10 is a diagram illustrating a laundry treating apparatus according another embodiment of the present invention. Different from the laundry treating apparatus shown in FIGS. 1 and 2, the solvent is volatilized by the hot air to be gaseous. An auxiliary condensation device 280 is provided to condense the gaseous solvent.

That is, a solvent receiving part 270, a surfactant receiving part 271 and a pump 272 are installed in a predetermined portion of the casing 10 or in the supporting compartment 85. The solvent supply pipe 273 connected to the pump is connected toward the front of the casing 10 to be connected to the spraying device 74 installed adjacent to the opening of the rotatable drum 20.

The hot air supply device 55 is provided in the casing 10 adjacent to the tub 15 to supply hot air to the rotatable drum 20. The hot air supply device 55 includes the heating device 61, the fan 62 and the guide duct 60. The guide duct 60 is connected to the tub 20. Here, the guide duct 60 is circulation duct-shaped and it guides air discharged from the tub 15 and the rotatable drum 20.

That is, a predetermined portion of the guide duct 60 is arranged toward the solvent receiving part 270 and the condensation device 280 is provided in the guide duct 60 is connected to the filter part 276 and the condensation device 280 provided under the filter part 276.

The solvent receiving part 270 is connected to a lower portion of the condensation device 280 and a closable valve 282 is provided between the condensation device 280 and the solvent receiving part 270.

Condensed solvent (L) is selectively supplied to the solvent receiving part 270 by the closable valve 282.

The guide duct 60 is connected to the portion where the fan 62 and the heating device 61 are installed.

Front surfaces of the solvent receiving part 270 and the surfactant receiving part 271 are exposed to the front of the supporting compartment 85 for the user to additionally supply solvent and surfactant. Also, a predetermined portion of the filter part 276 is exposed to the front of the supporting compartment 85 to be slidingly detachable.

The cover member 90 is coupled to the front of the supporting compartment 85 to open and close; in other words, cover the front of the supporting compartment 85. As necessary, the solvent receiving part 270, the surfactant receiving part 271 and the filter part 276 are exposed outside by the cover member 90 and in the other case they are not exposed by the cover member 90.

Figure 11:
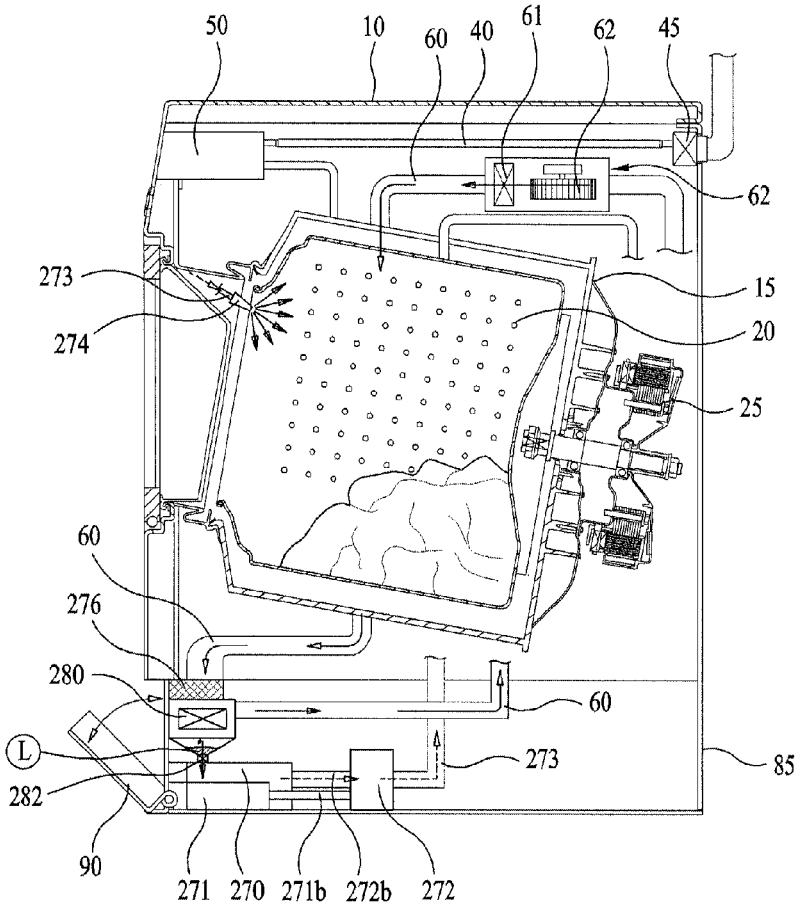
FIG. 11 is a diagram illustrating operation of dry-cleaning in the laundry treating machine according to another embodiment of the present invention.

FIG. 11 is a diagram illustrating operation of the laundry treating apparatus according to the above embodiment of the present invention shown in FIG. 10.

As shown in FIG. 11, once dry-cleaning starts, solvent and surfactant are mixedly moved to the pump 272 by the pumping of the pump 272 and the mixture is moved to the spraying device 274 along the solvent supply pipe 273 to be sprayed toward the laundry loaded in the rotatable drum 20.

Hence, with the rotation of the rotatable drum 20, the laundry is rotated and dropped to perform washing. After that, the heating device 61 and the fan 62 are operated to dry the laundry and hot air is supplied to the rotatable drum 20 along the guide duct 60.

The temperature inside the rotatable drum 20 is increased by the hot air supplied to the drum 20 such that the solvent is volatilized to be contained in air.

Hence, the gaseous solvent and air may be discharged from the rotatable drum 20 and the tub 15 to move toward the filter part 276 along the guide duct 60.

Lint and variations of it may be filtered from the laundry by the filter part 276 and the filtered air and solvent passes the condensation device 280.

If the solvent is condensed by the condensation device 280, solvent condensate is collected in the lower portion of the condensation device 280 and it is supplied to the solvent receiving part 270 by the opening of the closable valve 282.

In the meanwhile, cooled air having passed the condensation device 280 is moved toward the heating device 61 along the guide duct 60 and the heating device 61 heated the cooled air to move into the rotatable drum 20.

In reference to FIGS. 1 to 9, a control method of the laundry treating apparatus will be described.

According to the laundry treating apparatus according to the present invention, both washing and dry-cleaning may be possible in the single device. However, after the dry-cleaning, silicone solvent may remain inside the rotatable drum 20 and secondary contamination may occur in the laundry if washing for the laundry after the dry-cleaning is performed in this state.

As a result, it is necessary to clean the inside of the rotatable drum after dry-cleaning.

According to a drum inside cleaning step, it may be proposed that water may be provided to wash and clean the drum inside after the dry-cleaning unconditionally. Alternatively, the drum inside cleaning may be performed by the user's selection.

Specifically, it is determined by a control part (not shown) of the laundry treating apparatus whether a dry-cleaning step is complete. If it is determined that the dry-cleaning is complete, a predetermined amount of water is supplied to the rotatable drum 20 and wash off the solvent used in the dry-cleaning.

Such the process may be performed based on a program preset in the control part, irrelevant to the user's selection.

However, after the dry-cleaning, the user may dry-clean another laundry. In this case, the drum inside cleaning is unnecessary and thus it may be further provided to ask a user whether to perform the drum inside cleaning step.

As a result, it is requested to the user in a display window (not shown) as a touch pads whether to clean the drum inside. If the user selects 'OK', the drum cleaning step starts. If the user selects 'NO' or he/she may not select, the drum cleaning is reserved.

The washing machine composing the laundry treating apparatus according to the embodiments is embodied as a drum-type washing machine and the present invention is not limited thereto. A pulsator-type washing machine may be applicable to the present invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating apparatus comprising:
- a casing;
- a tub provided in the casing;
- a rotatable drum provided in the tub;
- a water supply part provided in the casing to supply water to the rotatable drum;
- a hot air supply device to supply hot air to the rotatable drum, the hot air supply device comprising a guide duct connected to a lower surface of the tub and an upper surface of the tub to circulate air in the tub, a heating device provided in the guide duct to generate the hot air supplied to the rotatable drum, and a fan provided in the guide duct to blow the generated hot air through the guide duct into an upper portion of the tub;
- a condensation device provided in the guide duct under the tub to condense dry-cleaning solvent discharged through the guide duct from a lower portion of the tub from a gaseous portion of the dry-cleaning solvent into a liquid form of the dry-cleaning solvent, wherein cooled air separated from the dry-cleaning solvent by having passed the condensation device is moved toward the heating device along the guide duct and heated by the heating device prior to being supplied into the tub; and
- a solvent supply part to supply the dry-cleaning solvent to the rotatable drum, wherein the solvent supply part comprises a solvent receiving part configured to store the dry-cleaning solvent and connected to a lower portion of the condensation device to store solvent condensate condensed by the condensation device, and a pump connected to the solvent receiving part to supply the dry-cleaning solvent to the rotatable drum via a solvent supply pipe.

2. The laundry treating apparatus as claimed in claim 1, wherein the solvent supply part further comprises:
- a spraying device connected to the pump to spray the dry-cleaning solvent into the rotatable drum.

3. The laundry treating apparatus as claimed in claim 1, further comprising:

a closable valve provided between the condensation device and the solvent receiving part to control a flow of the solvent condensate.

4. The laundry treating apparatus as claimed in claim 1, further comprising a filter part provided in the guide duct, wherein the filter part comprises a replaceable filter cartridge that is able to be inserted in the casing.

5. The laundry treating apparatus as claimed in claim 4, further comprising:

a surfactant receiving part provided alongside the solvent receiving part to receive surfactant; and a supply groove that is formed in front of the casing and that exposes a cover, wherein the cover is provided in the solvent receiving part and the surfactant receiving part to open the solvent receiving part and the surfactant receiving part, respectively.

6. The laundry treating apparatus as claimed in claim 5, further comprising:

a cover member rotatably coupled to an outer portion of the casing to prevent the filter cartridge or the cover from being exposed outside.

7. The laundry treating apparatus as claimed in claim 1, wherein:

the laundry treating apparatus comprises a washing machine and a drying machine;

a spraying device provided in the tub or the casing of the washing machine to spray the dry-cleaning solvent toward an opening of a rotatable drum of the washing machine; and the openings of the rotatable drums of the washing machine and the drying machine defining entrances through which laundry enters the respective rotatable drums.

8. The laundry treating apparatus as claimed in claim 7, wherein the solvent supply part is provided in the casing of the washing machine.

9. The laundry treating apparatus as claimed in claim 7, wherein:

supporting compartments are provided under the casings of the washing machine and the drying machine, respectively, to heighten an installation height of the rotatable drums, the supporting compartments being partitioned off from the casings; and the solvent receiving part is provided in the supporting compartments.

10. The laundry treating apparatus as claimed in claim 9, wherein the solvent supply part is provided in the supporting compartment of the washing machine.

11. The laundry treating apparatus as claimed in claim 9, wherein:

the solvent supply part comprises the solvent receiving part to receive the dry-cleaning solvent and a surfactant receiving part to receive surfactant; and a front of the supporting compartment of the washing machine comprising:

a supply groove exposing predetermined portions of the solvent receiving part and the surfactant receiving part to enable the dry-cleaning solvent or the surfactant to be supplied; and an attachment groove to enable a filter cartridge of a filter part to be replaceable.

12. The laundry treating apparatus as claimed in claim 11, wherein a cover member covering the solvent receiving part and the filter part is rotatably coupled to the front of the supporting compartment.

13. The laundry treating apparatus as claimed in claim 1, wherein the dry-cleaning solvent is silicone oil.

14. The laundry treating apparatus as claimed in claim 1, further comprising:

a filter part that is provided in the guide duct and that is configured to filter foreign substances included in the gaseous portion of the dry-cleaning solvent, wherein the condensation device is provided under the filter part.

15. The laundry treating apparatus of claim 14, wherein:

the condensation device is connected to the filter part and provided under the filter part such that air passes through the filter part prior to reaching the condensation device;

a front surface of the solvent receiving part is exposed at a front side of the casing for the solvent receiving part to receive the dry-cleaning solvent; and a portion of the filter part is exposed at a front side of the casing and is slidingly detachable.

16. The laundry treating apparatus of claim 14, wherein the condensation device is directly connected to the solvent receiving part through a valve such that the solvent condensate condensed by the condensation device falls directly to the valve through which it passes directly to the solvent receiving part.

* * * * *